US009398794B2

(12) United States Patent
Kim et al.

(10) Patent No.: US 9,398,794 B2
(45) Date of Patent: Jul. 26, 2016

(54) FOLDABLE POUCH FOR MOBILE TERMINAL

(71) Applicant: Samsung Electronics Co., Ltd., Gyeonggi-do (KR)

(72) Inventors: Sehun Kim, Gyeonggi-do (KR); Hyunju Shin, Busan (KR); Taewan Kim, Seoul (KR); Yonghoon Jin, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 14/163,573

(22) Filed: Jan. 24, 2014

(65) Prior Publication Data

US 2014/0202889 A1 Jul. 24, 2014

(30) Foreign Application Priority Data

Jan. 24, 2013 (KR) ..... 10-2013-0007898

(51) Int. Cl.
*B65D 5/52* (2006.01)
*A45C 11/00* (2006.01)

(52) U.S. Cl.
CPC ..... *A45C 11/00* (2013.01); *A45C 2011/003* (2013.01); *A45C 2200/15* (2013.01)

(58) Field of Classification Search
CPC ..... B65D 5/52; B65D 5/5206; B65D 5/5213; G06F 1/1626; G06F 1/1628; G06F 1/1633; G06F 1/1637; G06F 1/1641; A45C 2013/025; A47B 23/04; A47B 23/041; A47B 23/042; A47B 23/043; A47B 23/044; A47B 97/08
USPC ..... 206/45.2, 45.23, 45.24, 320, 576, 764, 206/751, 752, 754, 755, 748; 248/450, 455, 248/458, 459, 460, 465, 454
See application file for complete search history.

(56) References Cited

U.S. PATENT DOCUMENTS

| | | | | |
|---|---|---|---|---|
| D658,188 | S | 4/2012 | Diebel | |
| D691,142 | S | 10/2013 | Diebel | |
| D708,836 | S * | 7/2014 | Lee | D3/201 |
| D713,402 | S * | 9/2014 | Akana et al. | D14/341 |
| 8,960,421 | B1 * | 2/2015 | Diebel | 206/45.2 |
| 2014/0028903 | A1 | 1/2014 | Ohtaka et al. | |

FOREIGN PATENT DOCUMENTS

| | | |
|---|---|---|
| CN | 202351757 | 7/2012 |
| CN | 202612994 | 12/2012 |
| JP | 3174584 | 3/2012 |
| KR | 200464678 | 1/2013 |

* cited by examiner

*Primary Examiner* — Steven A. Reynolds
*Assistant Examiner* — Javier A Pagan
(74) *Attorney, Agent, or Firm* — The Farrell Law Firm, P.C.

(57) ABSTRACT

A foldable pouch mobile terminal cradle is provided, which includes a first surface including a first plurality of panels and a first plurality of folding lines; a second surface including a second plurality of panels and a second plurality of folding lines; a first cradle groove formed in an end panel of the second plurality of panels of the rear surface and that receives an edge of an opposite end panel by bending along the first plurality of folding lines and the second plurality of folding lines; and a second cradle groove formed in the end panel of the second plurality of panels of the rear surface, a predetermined distance from the first cradle groove, and that receives an edge formed from one of the first plurality of folding lines, by bending along the first plurality of folding lines and the second plurality of folding lines.

11 Claims, 11 Drawing Sheets

FOLDABLE POUCH FOR MOBILE TERMINAL

PRIORITY

This application claims priority under 35 U.S.C. §119(a) to a Korean Patent Application filed in the Korean Intellectual Property Office on Jan. 24, 2013 and assigned Serial No. 10-2013-0007898, the content of which is incorporated herein by reference.

BACKGROUND OF THE INVENTION

1. Field of the Invention

The present invention relates generally to a pouch, and more particularly, to a foldable pouch able to cradle a mobile terminal (hereinafter referred to as "a foldable pouch mobile terminal cradle") that can be utilized as a pouch for storing a mobile terminal and as a cradle forming multiple angles to support the mobile terminal in various positions for different operations.

2. Description of the Related Art

In general, a tablet Personal Computer (PC) is operated by using a touch screen instead of a keyboard or a mouse. Although a tablet PC often exhibits lower work convenience than a laptop computer, it is generally more portable than a laptop computer; and thus, the demand for tablet PCs has grown. Because a tablet PC is so portable, a protective case is a popular accessory for this type of device.

Further, a user is often inconvenienced by having to hold the table PC during operation. Accordingly, different support devices for tablet PCs have been developed.

For example, U.S. Pat. No. 8,143,982 describes a foldable accessory apparatus that attaches to and detached from a tablet PC using an internal magnetic element, which can be folded in an overlapped form as a support, as illustrated in FIG. 1.

Because the foldable accessory apparatus is fixed to the tablet PC and can be folded in only one direction, the foldable accessory apparatus has a structure that supports the tablet PC in only one direction and one angle. However, it is often desirable to support a tablet PC in various angles and directions, depending on the operation being performed. For example, when watching video it may be preferable for the tablet PC to be supported more upright than when entering text, for example, composing an email.

Further, because the foldable accessory apparatus is attached to and detached from the tablet PC using a magnetic element, the magnetic element may have a harmful influence on operating the tablet PC.

Further, in order to attach the foldable accessory apparatus to the tablet PC, a separate connection device is necessary and is protruded to the outside, which may disfigure an external appearance design of the tablet PC and increase a weight thereof.

SUMMARY OF THE INVENTION

The present invention has been made to address at least the problems and disadvantages described above and to provide at least the advantages described below.

Accordingly, an aspect of the present invention is to provide a foldable pouch mobile terminal cradle that supports a mobile terminal in various angles according to a user's use and preference.

Another aspect of the present invention is to provide a foldable pouch mobile terminal cradle that does not have an electrical influence on operation of the mobile terminal.

Another aspect of the present invention is to provide a foldable pouch mobile terminal cradle having a simple structure and manipulation convenience.

In accordance with an aspect of the present invention, a foldable pouch mobile terminal cradle is provided, which houses a mobile terminal between a front surface and a rear surface, and includes a first surface including a first plurality of panels and a first plurality of folding lines configured between the first plurality of panels; a second surface including a second plurality of panels and a second plurality of folding lines configured between the second plurality of panels, wherein the second plurality of panels of the rear surface align with the first plurality of panels of the first surface; a first cradle groove formed in an end panel of the second plurality of panels of the rear surface and that receives an edge of an opposite end panel by bending along the first plurality of folding lines and the second plurality of folding lines; and a second cradle groove formed in the end panel of the second plurality of panels of the rear surface, a predetermined distance from the first cradle groove, and that receives an edge formed from one of the first plurality of folding lines, by bending along the first plurality of folding lines and the second plurality of folding lines.

BRIEF DESCRIPTION OF THE DRAWINGS

The above and other aspects, features, and advantages of certain embodiments of the present invention will be more apparent from the following detailed description in conjunction with the accompanying drawings, in which.

DETAILED DESCRIPTION OF EMBODIMENTS OF THE PRESENT INVENTION

Figure 1:
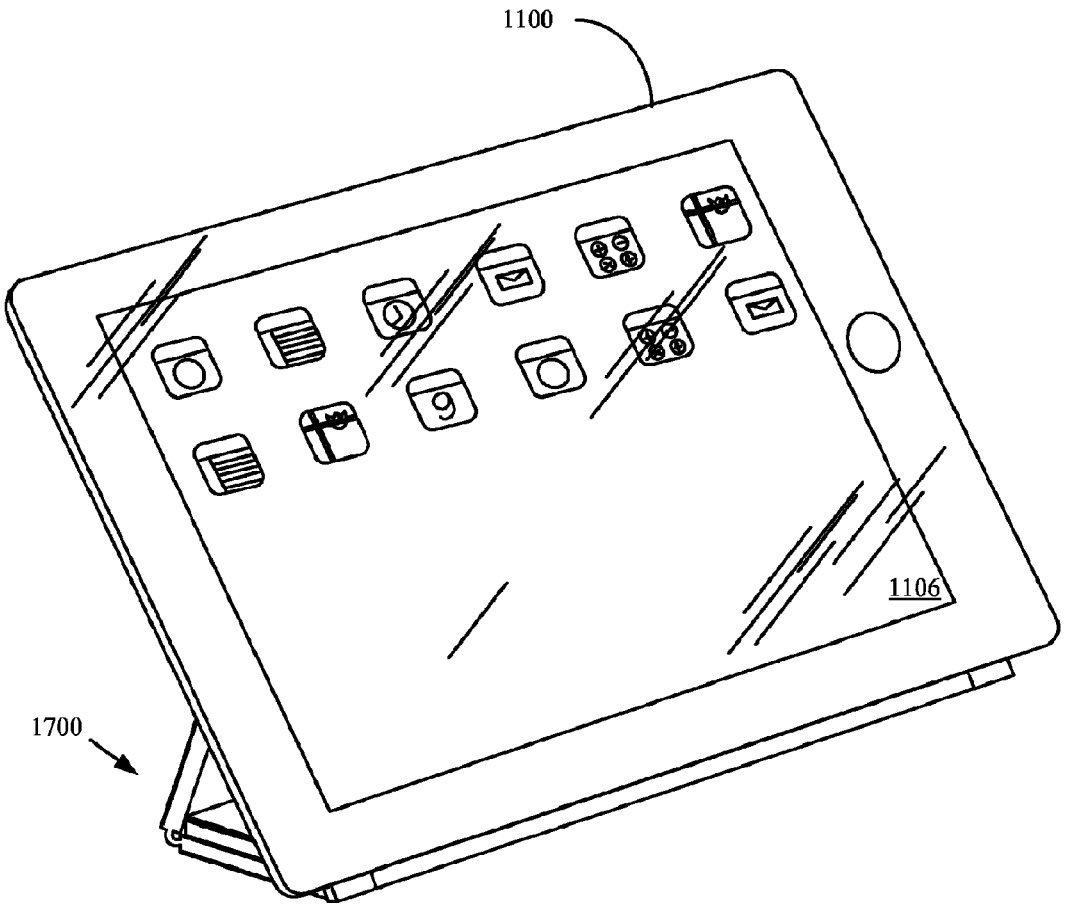
FIG. 1 [PRIOR ART]
FIG. 1 illustrates a conventional tablet PC support.
Figure 1:
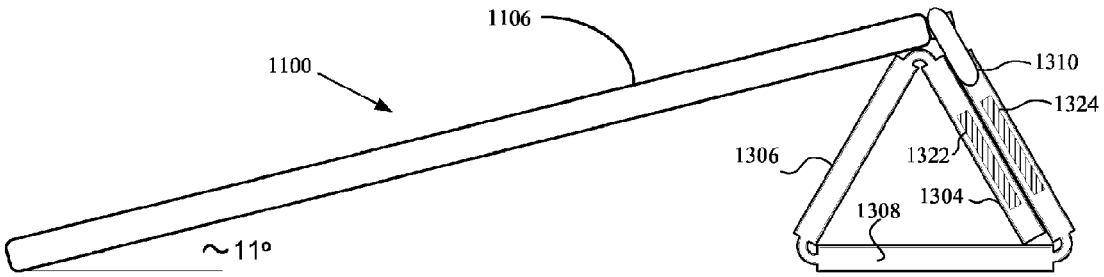
FIG. 1 [PRIOR ART]

Hereinafter, various embodiments of the present invention are described in detail with reference to the accompanying drawings. The same reference numbers are used throughout the drawings to refer to the same or like parts. The views in the drawings are schematic views only, and are not intended to be scaled or correctly proportioned. Detailed descriptions of well-known functions and structures incorporated herein may be omitted for clarity.

Examples of a mobile terminal described herein include, but are not limited to, a tablet PC, a mobile communication terminal, a mobile phone, a Personal Digital Assistant (PDA), a smart phone, an International Mobile Telecommunication 2000 (IMT-2000) terminal, a Code Division Multiple Access (CDMA) terminal, a Wideband Code Division Multiple Access (WCDMA) terminal, a Global System for Mobile communication (GSM) terminal, a General Packet Radio Service (GPRS) terminal, a Enhanced Data GSM Environment (EDGE) terminal, a Universal Mobile Telecommunication Service (UMTS) terminal, a digital broadcasting terminal, an Automated Teller Machine (ATM), etc.

Figure 2:
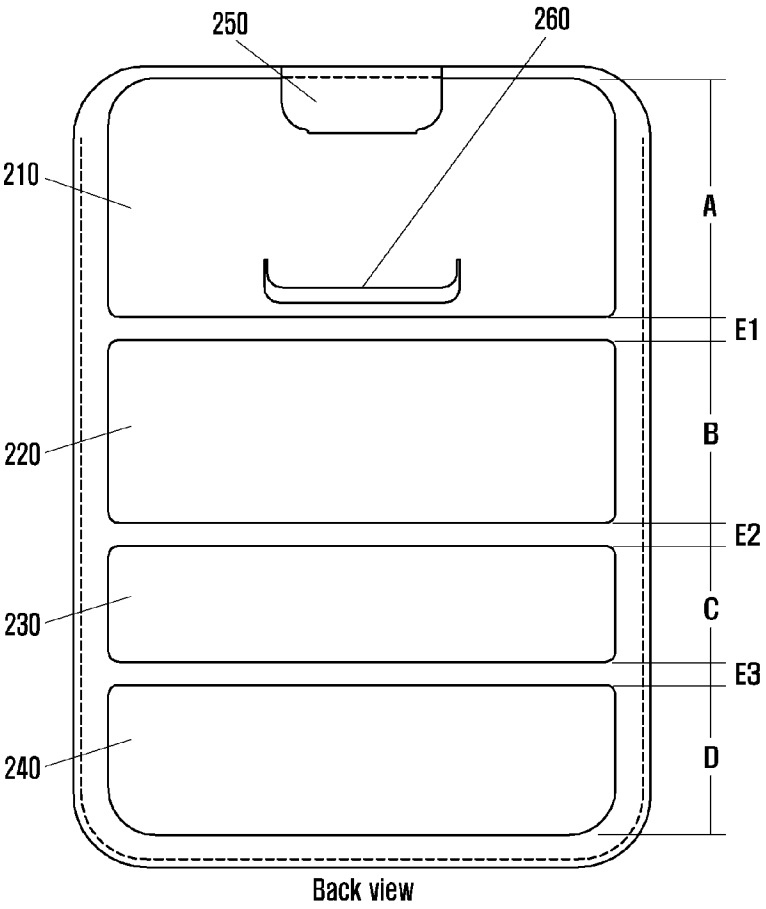
FIG. 2 illustrates a front view and a rear view of a foldable pouch mobile terminal cradle according to an embodiment of the present invention.
Figure 2:
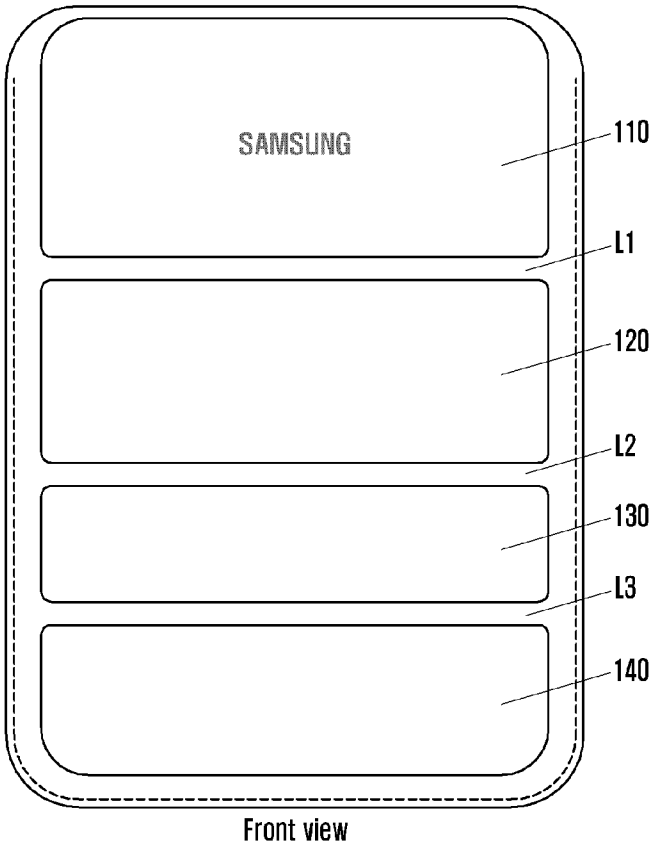
Figure 3:
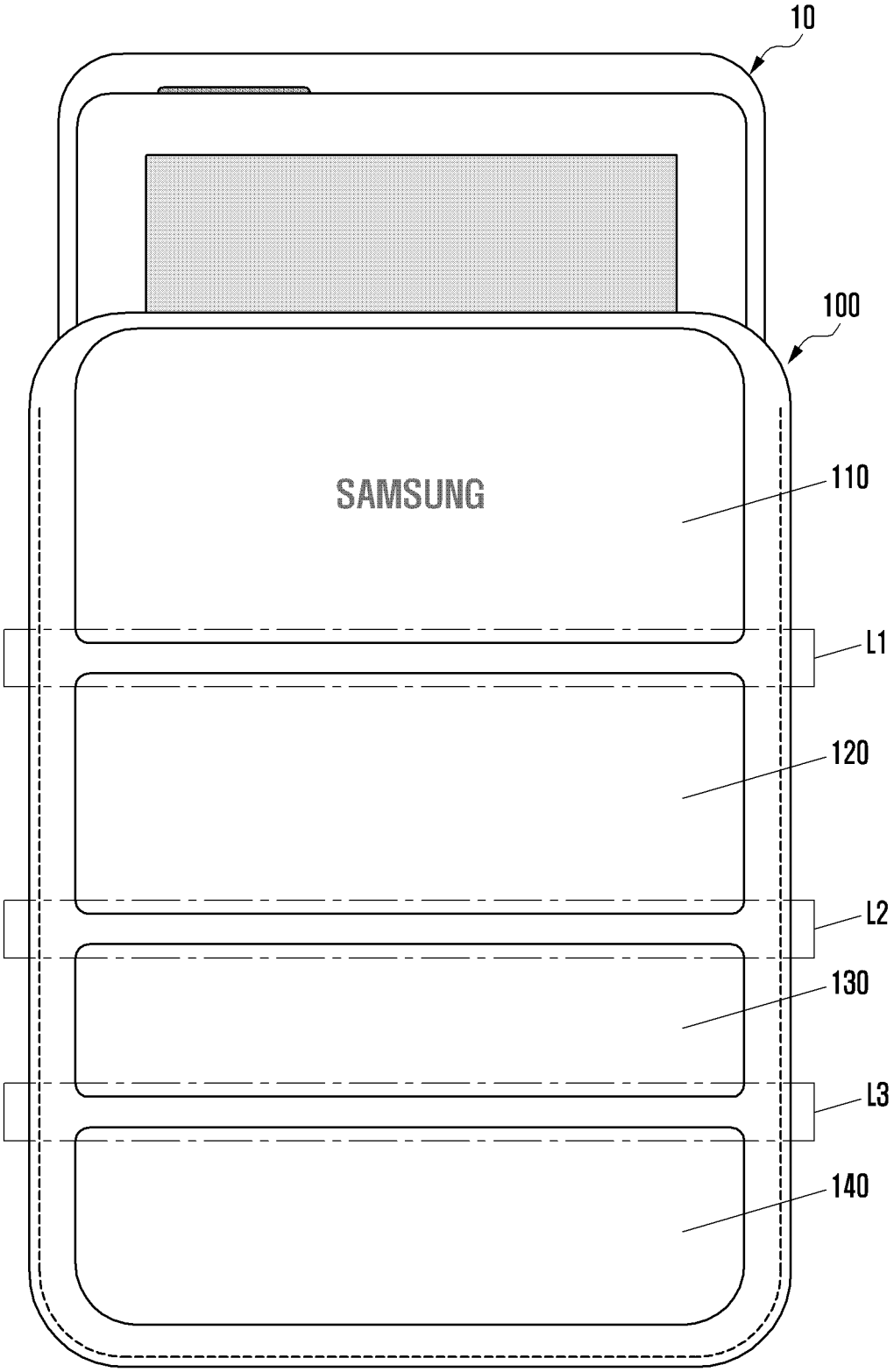
FIG. 3 illustrates a mobile terminal inserted into a foldable pouch mobile terminal cradle according to an embodiment of the present invention.

FIG. 2 illustrates a front view and a rear view of a foldable pouch mobile terminal cradle according to an embodiment of the present invention, and FIG. 3 illustrates a mobile terminal is inserted into a foldable pouch mobile terminal cradle according to an embodiment of the present invention.

Referring to FIGS. 2 and 3, a foldable pouch mobile terminal cradle 100 (hereinafter referred to as "pouch 100" for simplicity) houses a mobile terminal 10 between a front surface and a rear surface. For example, when a side of the pouch 100 is opened, the mobile terminal 10 may be inserted in the pouch 100 or removed from the pouch 100. Although FIGS. 2 and 3 illustrate the upper side of the pouch 100 being opened, one of the lower side, the left side, and the right side of the pouch 100 may be opened instead.

A front surface and a rear surface of the pouch 100 may be coupled by using an adhesive, a tape, bonding, and fusion-bonding at the inside of the remaining portions, or by sewing an edge of the front surface and the rear surface, except for an opened area that receives the mobile terminal 10.

FIG. 2 illustrates a sewing line that used to sew an edge of a front surface and a rear surface of the pouch 100.

The front surface and the rear surface of the pouch 100 include a multi-panel formed with a plurality of panels aligning as a pair in the front and rear surfaces, and a folding line is disposed between each panel.

Specifically, at the front surface of the pouch 100, a first panel 110, second panel 120, third panel 130, and fourth panel 140 are separately disposed by a predetermined gap from an upper end to a lower end of the pouch 100.

Similarly, at the rear surface of the pouch 100 corresponding to the front surface of the pouch 100, a fifth panel 210, sixth panel 220, seventh panel 230, and eighth panel 240 are separately disposed by a predetermined gap from an upper end to a lower end of the pouch 100.

A first folding line L1 is disposed between the first panel 110 and the second panel 120, and a second folding line L2 is disposed between the second panel 120 and the third panel 130, and a third folding line L3 is disposed between the third panel 130 and the fourth panel 140.

Here, the first panel 110 through the fourth panel 140 of the front surface face are aligned in a pair with the fifth panel 210 through the eighth panel 240 of the rear surface, respectively. Therefore, the first panel 110 and the fifth panel 210 are referred to as a first panel pair 110 and 210, and the second panel 120 and the sixth panel 220 are referred to as a second panel pair 120 and 220, the third panel 130 and the seventh panel 230 are referred to as a third panel pair 130 and 230, and the fourth panel 140 and the eighth panel 240 are referred to as a fourth panel pair 140 and 240.

The first folding line L1 through the third folding line L3 in the front surface may be formed aligning in a pair with folding lines in a rear surface of the pouch 100. That is, the first folding line L1 is disposed between the first panel 110 and the second panel 120, which is the same as a folding line E1 between the fifth panel 210 and the sixth panel 220, and the second folding line L2 is disposed between the second panel 120 and the third panel 130, which is the same as a folding line E2 between the sixth panel 220 and the seventh panel 230, and the third folding line L3 is disposed between the third panel 130 and the fourth panel 140, which is the same as a folding line E3 between the seventh panel 230 and the eighth panel 240.

The multiple panel pairs are formed so that each panel forms different lengths in a bending direction according to the folding line. For example, when a length of the first panel pair 110 and 210 is A, a length of the second panel pair 120 and 220 is B, a length of the third panel pair 130 and 230 is C, and a length of the fourth panel pair 140 and 240 is D, a length comparison of the panel pairs may be represented by A>B>D>C.

When an entire width of the pouch 100 is 199.5 mm, A, B, C, and D may be formed with a length of 82.2 mm, 63 mm, 40 mm, and 51.5 mm, respectively, and a length of each folding line may be 8 mm.

Although FIGS. 2 and 3 illustrate eight panels, i.e., four panel pairs, and three folding lines disposed at a front surface and a rear surface of the pouch 100, the present invention is not limited thereto and the number of panels may be greater than or less than eight and folding lines corresponding thereto may be disposed and be paired at a front surface and a rear surface of the pouch 100.

An outer surface of the front surface and the rear surface of the pouch 100 may be formed with different materials enclosing a plurality of folding lines L1 through L3 between panels 110 through 140 and 210 through 240 and the adjacent panels thereto. The different materials may include at least one of rubber, urethane, silicon, leather, and fiber.

An inner surface of the front surface and the rear surface of the pouch 100 may be formed with at least one of microfiber, chamois, synthetic leather, and suede. Thus, a display of the mobile terminal 10 can be protected from scratch.

The multi-panel may be formed with polycarbonate enclosed by the sheath, and the folding lines L1 to L3 may be formed by the sheath without filling between the adjacent panels.

Figure 4:
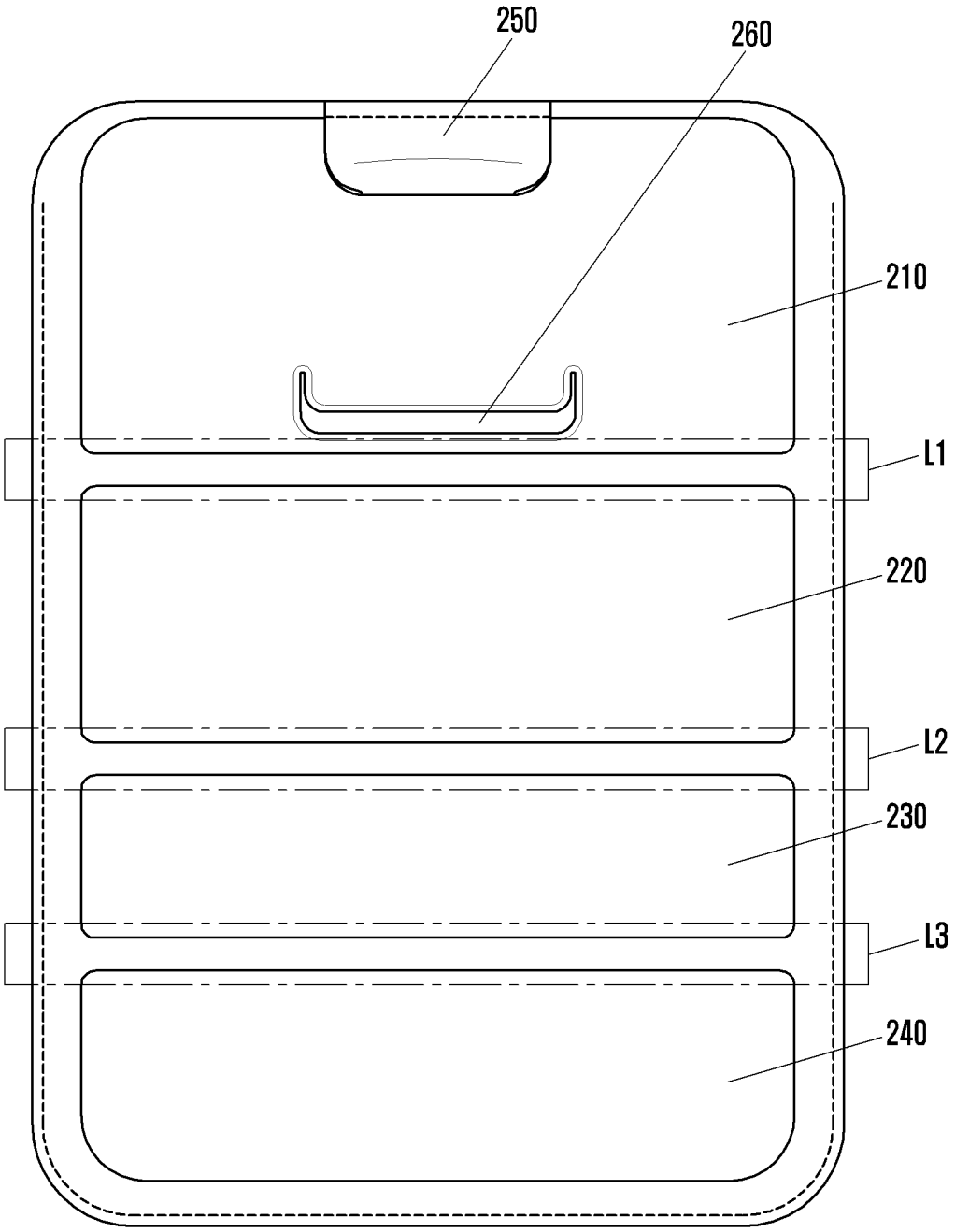
FIG. 4 illustrates a rear surface of a foldable pouch mobile terminal cradle according to an embodiment of the present invention.

FIG. 4 illustrates a rear surface of a foldable pouch mobile terminal cradle according to an embodiment of the present invention.

Referring to FIG. 4, the rear surface includes a first cradle groove 260 formed in a portion of an end panel of the foldable pouch 100 and a second cradle groove 250 formed in a portion of a panel separated by a predetermined distance from the first cradle groove 260. Specifically, the first cradle groove 260 is formed between a panel in which a portion of the fifth panel 210 is cut and a recess of the fifth panel 210 corresponding to the cut panel in a lower end portion of the fifth panel 210.

The second cradle groove 250 may be formed using a loop tab fixed to an edge of an upper end portion of the fifth panel 210. That is, the second cradle groove 250 may be formed between a loop tab in a direction opposite to a direction in which a portion is fixed to the fifth panel 210 and the fifth panel 210 corresponding to the loop tab. The loop tab may be integrally formed within the fifth panel 210 or a separated form of the loop tab may be partially fixed to the fifth panel 210.

In the condition of the above-mentioned example with values, a width of a first cradle groove 260 may be 65 mm, a length of a panel having a cut portion may be 9.5 mm, and a length of a recess corresponding thereto may be 14.9 mm. A length of a fixed portion for fixing a cradle tab, which is in a second cradle groove 250 may be 10 mm, and a length of an entire cradle tab including the fixing portion may be 22.8 mm.

Referring to FIG. 4, the first cradle groove 260 and the second cradle groove 250 may be formed one by one at the center based on the center of the fifth panel 210 or may be formed with a plurality of grooves formed in a pair in an opposite direction regarding to the center of the fifth panel 210. For example, at the left side and the right side of the fifth panel 210, a pair of first cradle grooves and a pair of second cradle grooves, respectively may be formed.

Further, FIG. 4 illustrates an example in which the first cradle groove 260 and the second cradle groove 250 are disposed in an upper end portion and a lower end portion of the fifth panel 210, but the first cradle groove 260 and the second cradle groove 250 may be disposed in different panels. For example, the first cradle groove 260 may be disposed in an upper end portion of the fifth panel 210, and the second cradle groove 250 may be disposed in an upper end portion of the sixth panel 220.

FIG. 4 illustrates an example in which a cut portion of a panel is formed as the first cradle groove 260 of the foldable pouch 100 and in which a loop tab is formed as the second cradle groove 250, but the present invention is not limited thereto and the first cradle groove 260 and the second cradle groove 250 may be formed by one of a loop tab or a cut portion of a panel.

Figure 5:
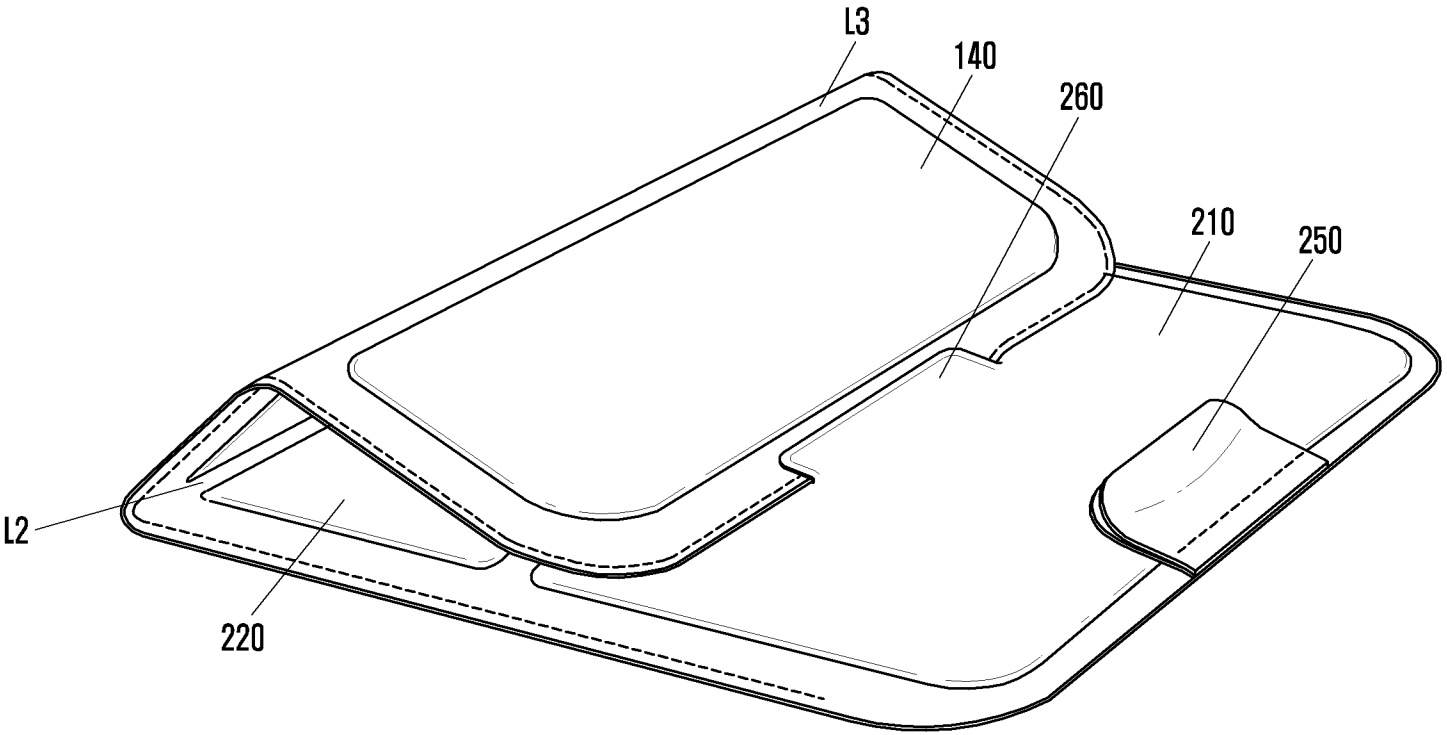
FIG. 5 illustrates a foldable pouch mobile terminal cradle providing a first support angle according to an embodiment of the present invention.
Figure 6:
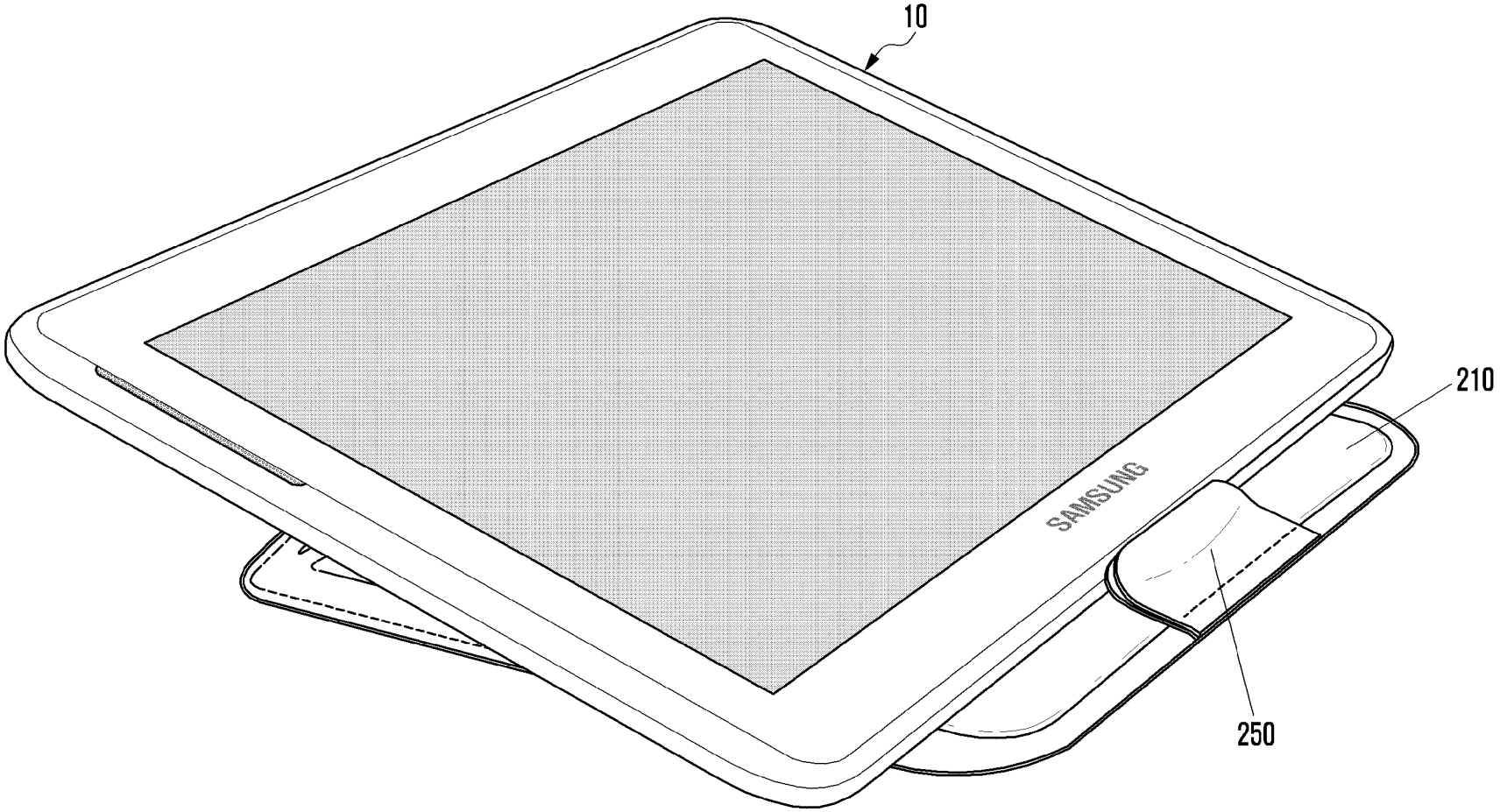
FIG. 6 illustrates a mobile terminal being supported by a foldable pouch mobile terminal cradle providing the first support angle according to an embodiment of the present invention.

FIG. 5 illustrates a foldable pouch mobile terminal cradle providing a first support angle, and FIG. 6 illustrates a mobile terminal supported in the first support angle in FIG. 5.

Referring to FIG. 5, the pouch 100 may insert an edge of the fourth panel pair 140 and 240 into the first cradle groove 260 by bending the second folding line L2 and the third folding line L3. Specifically, when a rear surface of the foldable pouch 100 is turned upward, by putting the first panel pair 110 and 210 and the second panel pair 120 and 220 on the ground and by bending the second folding line L2, the third panel pair 130 and 230 and the fourth panel pair 140 and 240 are put on top of the first panel pair and the second panel pair.

Thereafter, by bending the third folding line L3, the fourth panel pair 140 and 240 may be stood in a first angle from the ground, and an edge of the fourth panel pair 140 and 240 may be inserted into the first cradle groove 260. Alternatively, an edge of the fourth panel pair 140 and 240 may be inserted into the second cradle groove 250.

The mobile terminal 10 may be supported in a first angle by the foldable pouch 100, as illustrated in FIG. 6.

Referring to FIG. 6, by inserting an edge of the fourth panel pair 140 and 240 into the first cradle groove 260, the fourth panel pair 140 and 240 are obliquely stood, and in this state, by inserting an edge of the mobile terminal 10 into the second cradle groove 250 and by placing a rear surface of the mobile terminal 10 on the stable point formed by the obliquely stood fourth panel pair 140 and 240, the mobile terminal 10 may be supported in a first angle.

The first angle is about 30° that can make easily, for example inputting a text through a virtual keyboard displayed on a touch screen, drawing a picture or writing a character using a stylus touch pen, or reading an e-book.

Figure 7:
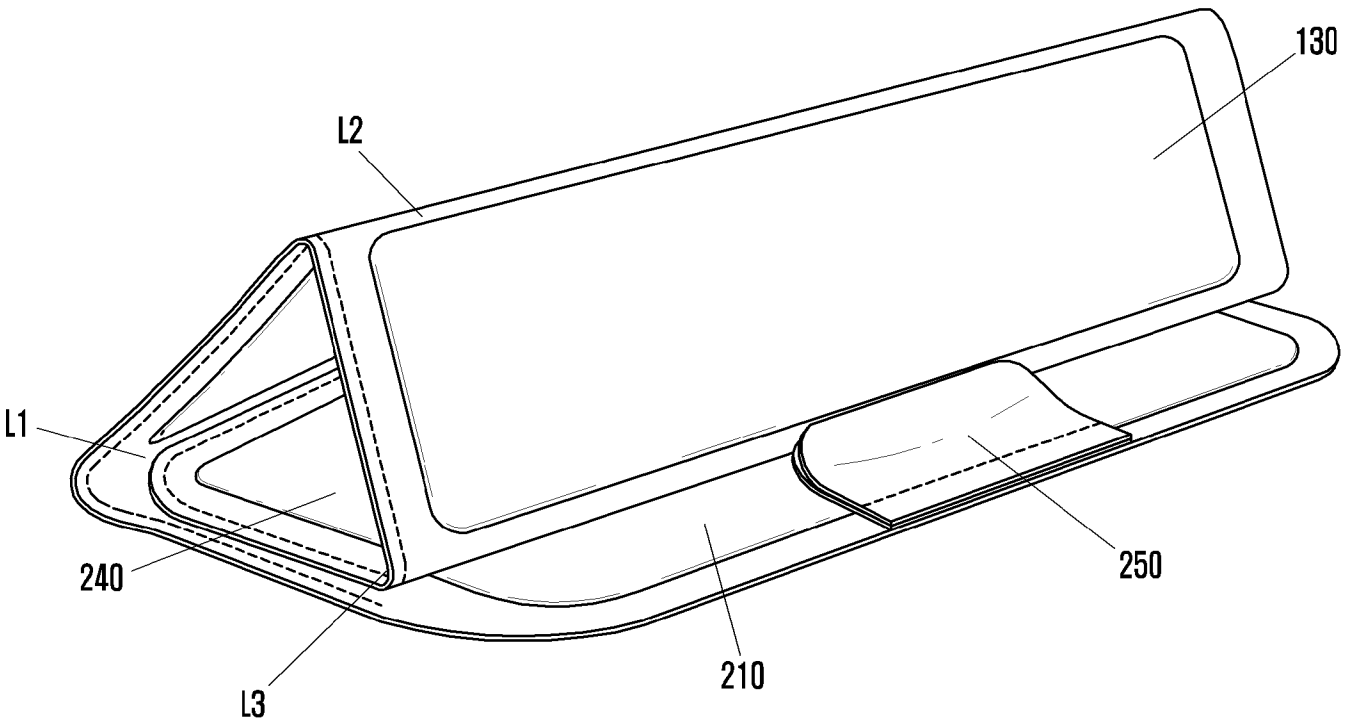
FIG. 7 illustrates a foldable pouch mobile terminal cradle providing a second support angle according to an embodiment of the present invention.
Figure 8:
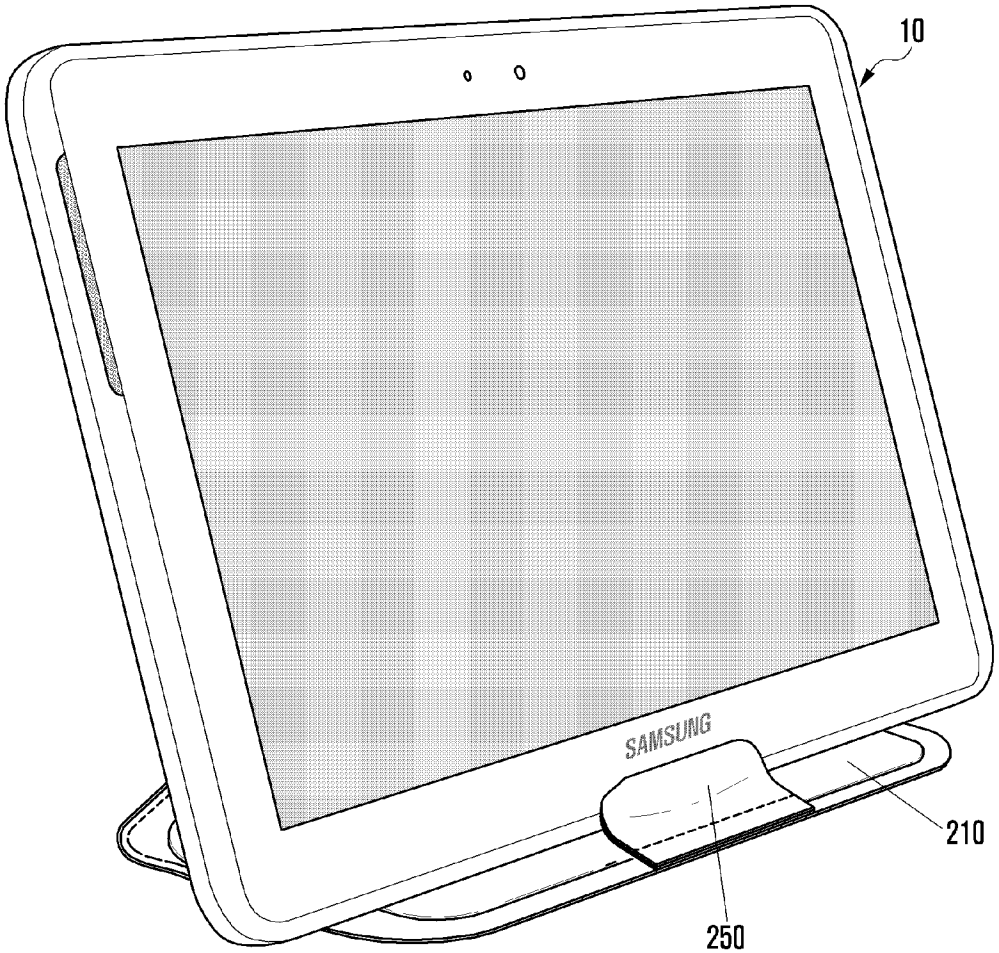
FIG. 8 illustrates a mobile terminal being supported by a foldable pouch mobile terminal cradle providing a second support angle according to an embodiment of the present invention.

FIG. 7 illustrates a foldable pouch mobile terminal cradle providing a second support angle, and FIG. 8 illustrates a mobile terminal is supported in the second support angle in FIG. 7.

Referring to FIG. 7, the pouch 100 may insert the edge of the third panel pair 130 and 230 to the second cradle groove 250 by bending each of the first folding line L1, second folding line L2, and third folding line L3. Specifically, when a rear surface of the foldable pouch 100 is turned upward, by bending the first folding line L1, the second panel pair 120 to 140 through the fourth panel pair 220 to 240 are disposed on top of the first panel pair 110 and 210 put on the ground. Thereafter, by bending the second folding line L2 and the third folding line L3, the fourth panel pair 140 and 240 are overlapped on the first panel pair 110 and 210, and the edge of the third panel pair 130 and 230 may be inserted into the second cradle groove 250 so that the third panel pair 130 and 230 may be supported obliquely from the ground.

Alternatively, at the second cradle groove 250, at least one of the third folding line L3 between the third panel pair 130 and 230 and the fourth panel pair 140 and 240 and one surface of the third panel pair 130 and 230 may be disposed to be faced with a loop tab.

When bending the first folding line L1 through the third folding line L3 as described above, the multi-panel may be formed in a triangular pillar structure.

The mobile terminal 10 may be supported in a second angle to the foldable pouch 100 formed in the way as illustrated in FIG. 8. That is, by inserting an edge of the mobile terminal 10 into the second cradle groove 250 illustrated in FIG. 7, the mobile terminal 10 may be supported in a second angle.

The second angle, for example, about 75°, may be preferential for viewing DMB, a moving picture, an image, etc., through the mobile terminal 10.

Figure 9:
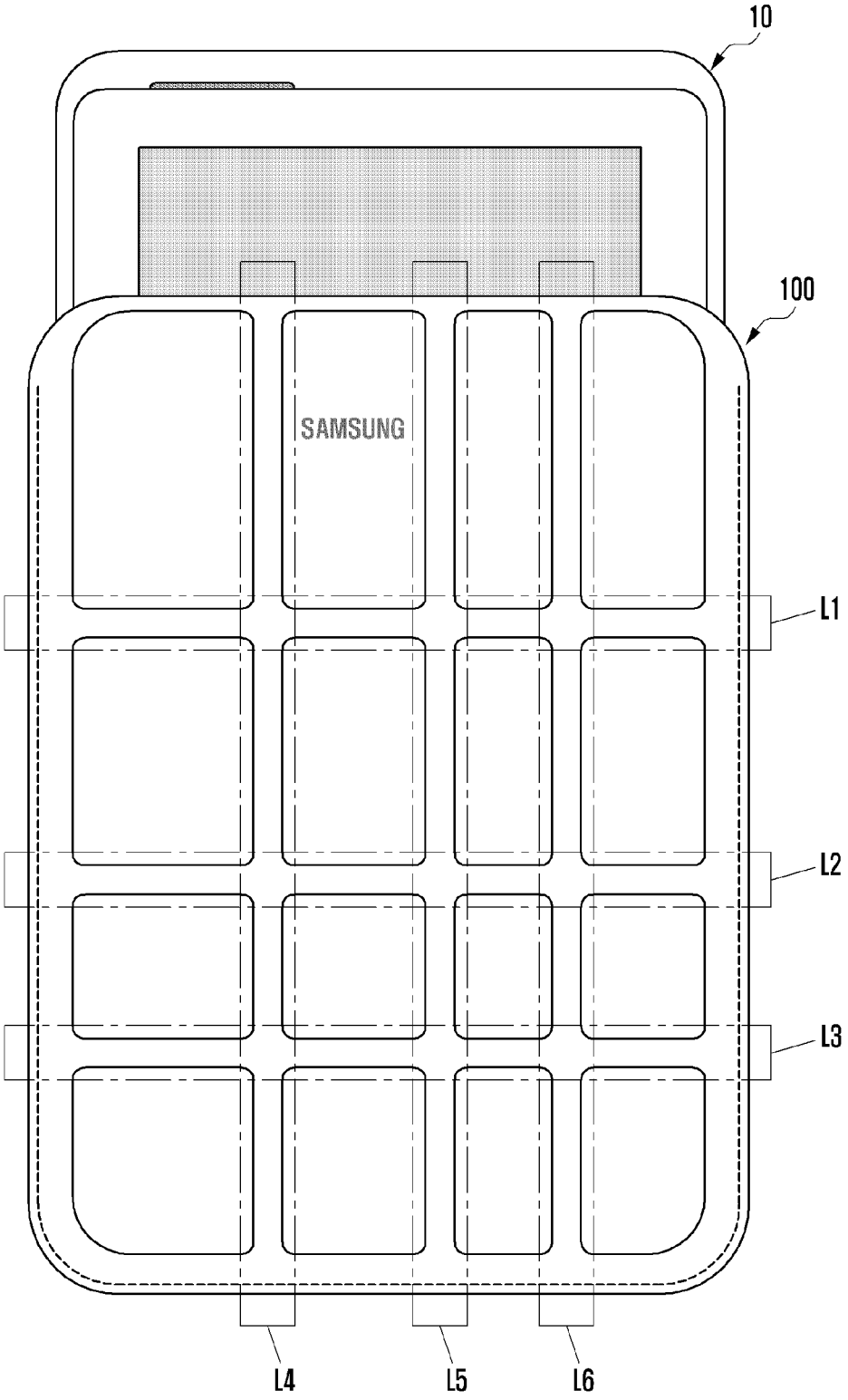
FIG. 9 illustrates a front surface of a foldable pouch mobile terminal cradle according to an embodiment of the present invention.

FIG. 9 illustrates a front surface of a foldable pouch mobile terminal cradle according to an embodiment of the present invention.

Figure 10:
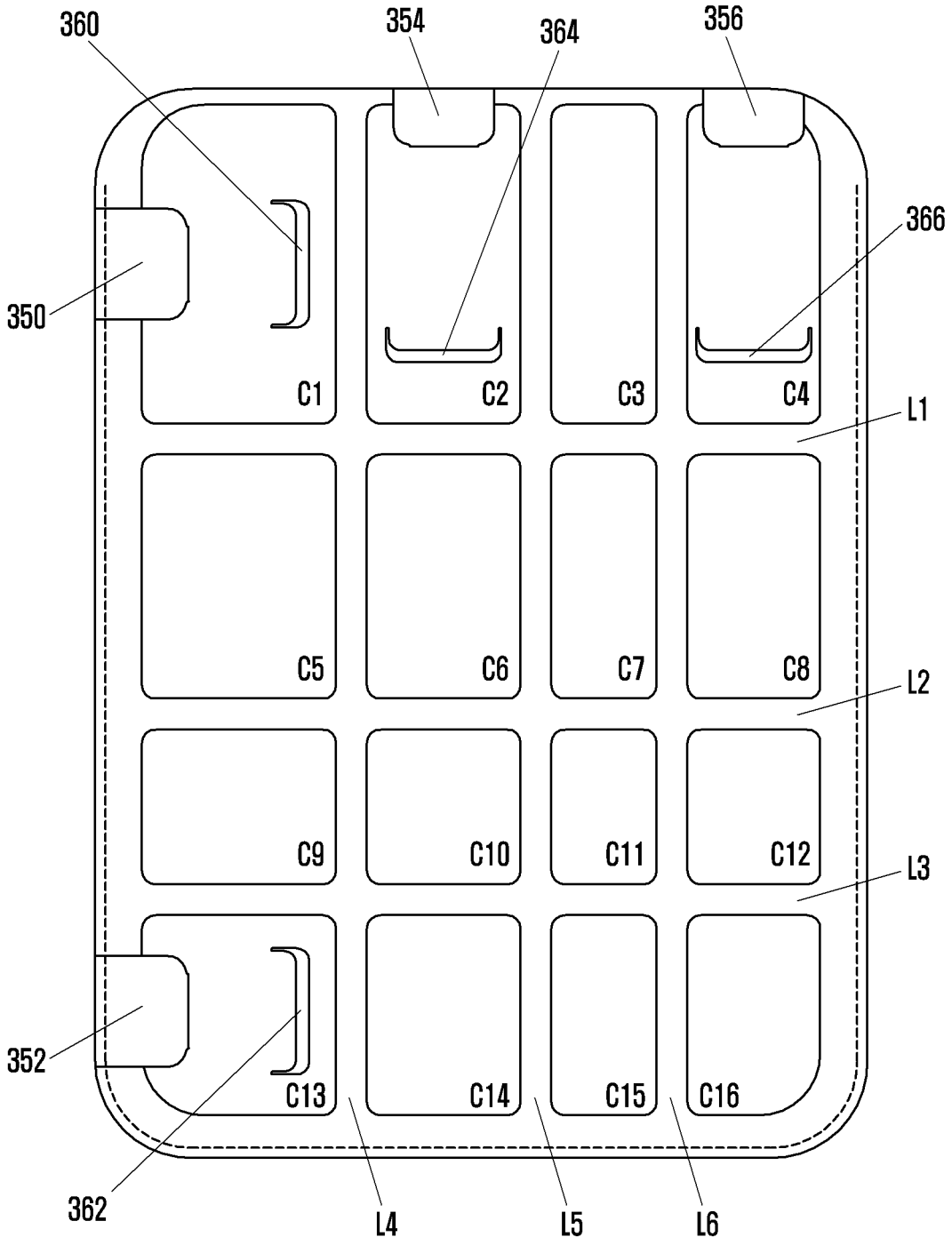
FIGS. 10 and 11 are diagrams illustrating a rear surface of the foldable pouch mobile terminal cradle according to an embodiment of the present invention.
Figure 11:
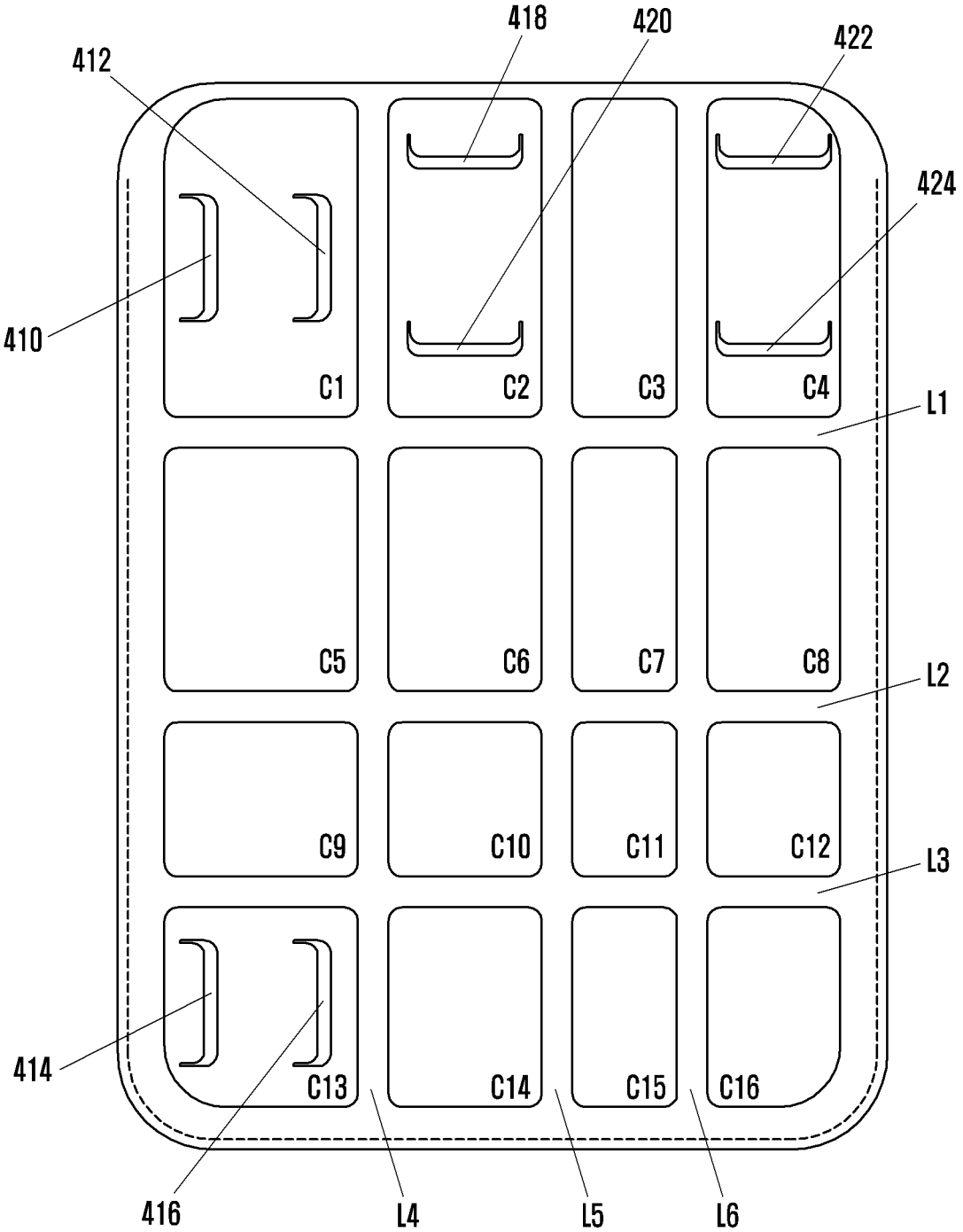

FIGS. 10 and 11 are diagrams illustrating a rear surface of a foldable pouch mobile terminal cradle according to an embodiment of the present invention.

Hereinafter, a detailed description of the same structure as a structure of a foldable pouch used as a cradle is omitted.

The pouch 100 illustrated in FIGS. 9 to 11 can be bent in a horizontal direction or a vertical direction as a bi-directional cradle.

Referring to FIG. 9, a front surface and a rear surface of the pouch 100 include a lattice panel formed with a plurality of panels aligned in a pair, and a folding line is disposed between the lattice panel. A plurality of folding lines L1 through L6 intersect in a horizontal direction and a vertical direction, separating the lattice panels.

Referring to FIG. 10, a front surface and a rear surface of the pouch 100 may include a plurality of lattice panels C1 to C16 divided by a plurality of folding lines L1 to L6 intersecting in a horizontal direction and a vertical direction at the front surface and the rear surface. That is, when a front surface and a rear surface of the foldable pouch 100 are divided by the folding lines C1 to C16 of a lattice pattern, the plurality of lattice panels C1 to C16 indicate areas into which each of the front surface and the rear surface is divided.

Similarly, a plurality of lattice panels C1 to C16 of the front surface of the pouch 100 and a plurality of lattice panels C1 to C16 of the rear surface thereof are formed in a facing pair, and a plurality of folding lines L1 to L6 in the front surface are formed in a pair with the folding lines in the rear surface of the pouch 100.

Although FIGS. 9 to 11 illustrate three folding lines L1 through L3 in a horizontal direction and three folding lines L4 through L6 in a vertical direction are illustrated, but the present invention is not limited thereto and at least one folding line may be formed in each direction.

A cradle groove formed in a cradle for supporting the pouch 100 in a vertical direction may be formed in at least one lattice panel positioned at an upper end portion of a vertical direction. For example, the second lattice panel C2 and the fourth lattice panel C4 in a cradle folded in a vertical direction may include first cradle grooves 364 and 366 and second cradle grooves 354 and 356, respectively.

The second cradle grooves 354 and 356 may be formed using a loop tab fixed to an edge of an upper end portion of the pouch 100. That is, the second cradle grooves 354 and 356 may be formed between a loop tab in a direction opposite to a direction in which a portion of the second lattice panel C2 and the fourth lattice panel C4 is fixed and the second lattice panel C2 and the fourth lattice panel C4 corresponding to a lower portion of the loop tab. Each of the loop tab may be integrally formed with the second lattice panel C2 and the fourth lattice panel C4, or a separated form of the loop tab may be fixed to a portion of each of the second lattice panel C2 and the fourth lattice panel C4.

The first cradle grooves 364 and 366 may be formed between a panel in which a portion of the second lattice panel C2 and the fourth lattice panel C4 is cut in a lower end portion of the second lattice panel C2 and the fourth lattice panel C4 and recesses of the second and fourth lattice panels corresponding to a lower end portion of the cut panel.

By bending the second folding line L2 and the third folding line L3, an edge of a thirteen lattice panel C13 through a sixteenth lattice panel C16 may be inserted into the first cradle grooves 364 and 366. Thereby, the thirteen lattice panel C13 through the sixteenth lattice panel C16 may be stood obliquely from the ground. In a state in which the thirteen lattice panel C13 through the sixteenth lattice panel C16 are obliquely stood, by inserting the mobile terminal 10 into the second cradle grooves 354 and 356 and by placing a rear surface of the mobile terminal 10 to the stable point formed by the thirteen lattice panel C13 through the sixteenth lattice panel C16, the mobile terminal 10 may be supported in a third angle.

The second cradle grooves 354 and 356 may be formed using a loop tab fixed to an upper end portion of the second lattice panel C2 through the fourth lattice panel C4. That is, the second cradle grooves 354 and 356 may be formed between a loop tab in a direction opposite to a direction in which a portion is fixed to each of the second lattice panel C2 and the fourth lattice panel C4 and the second lattice panel C2 and the fourth lattice panel C4 corresponding to a lower portion of the loop tab. The loop tab may be formed integrally within the second lattice panel C2 and the fourth lattice panel C4 or a separated form of the loop tab may be fixed to a portion of the second lattice panel C2 and the fourth lattice panel C4.

By bending the first folding line L1, the second folding line L2, and the third folding line L3, lattice panels are folded in a triangular pillar structure, and an edge of a ninth lattice panel C9 through a twelfth lattice panel C12 may be inserted into the second cradle grooves 354 and 356.

In this case, at the second cradle grooves 354 and 356, the ninth lattice panel C9 through the twelfth lattice panel C12 in which an edge is inserted into the second cradle grooves 354 and 356, and the mobile terminal 10 may be supported in a fourth angle different from the third angle.

Third cradle grooves 360 and 362 may be formed between a panel in which a portion of the first lattice panel C1 and the thirteen lattice panel C13 is cut in a lower end portion of each of the first lattice panel C1 and the thirteen lattice panel C13 and a recess of the first lattice panel C1 and the thirteen lattice panel C13 corresponding to a lower portion of the cut panel.

By bending the fifth folding line L5 and the sixth folding line L6, edges of a fourth lattice panel C4, eighth lattice panel C8, twelfth lattice panel C12, and sixteenth lattice panel C16 may be inserted into the third cradle grooves 360 and 362. In this case, the mobile terminal 10 may be supported in a fifth angle.

Fourth cradle grooves 350 and 352 may be formed between a loop tab fixed to an upper end portion of each of the first lattice panel C1 and the thirteen lattice panel C13 and the first lattice panel C1 and the thirteen lattice panel C13 corresponding to a lower portion of the loop tab.

By folding the fourth folding line L4 through the sixth folding line L6 causing the cradle in a triangular pillar structure, an edge of a third lattice panel C3, seventh lattice panel C7, eleventh lattice panel C11, and fifteenth lattice panels C15 may be inserted into the fourth cradle grooves 350 and 352. By inserting an edge of the mobile terminal 10 between the fourth cradle grooves 350 and 352 and one surface of the third lattice panel C3, seventh lattice panel C7, eleventh lattice panel C11, and fifteenth lattice panels C15, the mobile terminal 10 may be supported in a sixth angle.

A foldable pouch according to the present invention can support a mobile terminal in multiple angles according to a user's various use and preference and can support a mobile terminal in a horizontal direction or a vertical direction, thereby improving user's convenience.

FIG. 11 illustrates an embodiment in which entire cradle grooves in FIG. 10 are formed between a panel having a cut portion and a recess corresponding to the cut panel.

Referring to FIG. 11, a plurality of cradle grooves may be formed between a panel having a cut portion and a recess corresponding thereto, but a plurality of cradle grooves are not limited thereto and may be formed with at least one of grooves between a loop tab and a panel corresponding thereto.

As described above, a foldable pouch according to the present invention can support a mobile terminal in multiple angles according to a user's use and preference and can be easily manipulated.

Further, when carrying and storing the mobile terminal, by mounting a mobile terminal in a pouch, the foldable pouch can protect a display; and when using the mobile terminal, the foldable pouch supports the mobile terminal as a cradle. Thus, a user can conveniently carry the mobile terminal with the foldable pouch, and the foldable pouch has economical advantage.

Further, when storing and supporting the mobile terminal, without using a magnetic element, the foldable pouch hardly has electrical and physical influence on operation of the mobile terminal, and reliability of the foldable pouch can be thus improved.

Although certain embodiments of the present invention have been described in detail hereinabove, it should be clearly understood that many variations and modifications of the basic inventive concepts herein described, which may appear to those skilled in the art, will still fall within the spirit and scope of the various embodiments of the present invention as defined in the appended claims.

What is claimed is:

1. A foldable pouch mobile terminal cradle that houses and supports a mobile terminal, the foldable pouch mobile terminal cradle comprising:

a first surface including a first plurality of panels and a first plurality of folding lines configured between the first plurality of panels;

a second surface including a second plurality of panels and a second plurality of folding lines configured between the second plurality of panels, wherein the second plurality of panels of the second surface align with the first plurality of panels of the first surface;

a first cradle groove formed in an end panel of the second plurality of panels of the second surface and that receives an edge of an opposite end panel by bending along the first plurality of folding lines and the second plurality of folding lines; and a second cradle groove formed in the end panel of the second plurality of panels of the second surface, a predetermined distance from the first cradle groove, and that receives an edge formed from one of the first plurality of folding lines, by bending along the first plurality of folding lines and the second plurality of folding lines, wherein each of the first plurality of panels and the second plurality of panels is disposed in at least one among a plurality of rows and a plurality of columns, and wherein the at least one of the plurality of rows have dimensions different from the remaining rows, and the at least one of the plurality of columns have dimensions different from the remaining columns, each of the first plurality of panels and the second plurality of panels includes a first panel to a fourth panel disposed in order from an upper end of the first surface and the second surface, respectively, and each of the first plurality of folding lines and the second plurality of folding lines includes a first folding line to a third folding line, respectively, and the second cradle groove receives an edge of the mobile terminal and the mobile terminal is supported in a first angle or a second angle, an edge of the fourth panel pair being inserted into the first cradle groove by bending the second folding line and the third folding line to form a triangle structure, and the third folding line being inserted into the second cradle groove by bending the first folding line through the third folding line to form a triangular pillar structure.

2. The foldable pouch mobile terminal cradle of claim 1, wherein the mobile terminal is supported in a first angle, when the edge of the opposite end panel is received in the first cradle groove.

3. The foldable pouch mobile terminal cradle of claim 1, wherein the mobile terminal is supported in a second angle, when the edge formed from the one of the first plurality of folding lines is received in the second cradle groove.

4. The foldable pouch mobile terminal cradle of claim 1, wherein the mobile terminal is supported in different angles by using the first cradle groove and the second cradle groove, respectively.

5. The foldable pouch mobile terminal cradle of claim 1, wherein at least one of the first cradle groove and the second cradle groove are formed between the end panel having a cut portion and a recess corresponding to a lower portion of the cut portion, or between a loop tab in which an edge is fixed to a portion of the end panel and the end panel corresponding to a lower portion of the loop tab.

6. The foldable pouch mobile terminal cradle of claim 1, wherein an outer surface of the first plurality of panels and the second plurality of panels is sheathed in a sheath.

7. The foldable pouch mobile terminal cradle of claim 6, wherein the first plurality of panels and the second plurality of panels are formed with polycarbonate, and the first plurality of folding lines and the second plurality of folding lines are formed with the sheath.

8. The foldable pouch mobile terminal cradle of claim 7, wherein the sheath comprises at least one of rubber, urethane, silicon, leather, and fiber.

9. The foldable pouch mobile terminal cradle of claim 1, wherein inner surfaces of the first surface and the second surface are formed with at least one of microfiber, chamois, synthetic leather, and suede.

10. The foldable pouch mobile terminal cradle of claim 1, wherein a length of the first panel is greater than a length of a second panel is greater than a length of the fourth panel is greater than a length of a third panel.

11. The foldable pouch mobile terminal cradle of claim 10, wherein a length ratio of a horizontal direction or a vertical direction of the first panel to the fourth panel is 822:630:400:515.

* * * * *